US005109877A

United States Patent [19]

Takeda

[11] Patent Number: 5,109,877

[45] Date of Patent: May 5, 1992

[54] MAKE-UP BRUSH DEVICE

[76] Inventor: Shiro Takeda, Kumano-Cho 3538-3, Aki-gun, Hiroshima, Japan

[21] Appl. No.: 657,816

[22] Filed: Feb. 20, 1991

[30] Foreign Application Priority Data

Feb. 20, 1990 [JP] Japan ..... 2-39494
Feb. 23, 1990 [JP] Japan ..... 2-17844

[51] Int. Cl.[5] ..... A45D 40/26

[52] U.S. Cl. ..... 132/218; 132/318; 401/31; 401/102

[58] Field of Search ..... 132/216, 218, 317, 318, 132/320, 313; 401/31, 102

[56] References Cited

U.S. PATENT DOCUMENTS

| | | | |
|---|---|---|---|
| 846,547 | 3/1907 | Brown | 401/102 |
| 953,316 | 3/1910 | Brown | 401/102 |
| 1,153,055 | 9/1915 | Fuller | 401/31 |
| 2,142,312 | 1/1939 | Heinz | 132/318 |
| 3,001,531 | 9/1961 | Gazdik | 401/31 |
| 3,181,539 | 5/1965 | Aston | 132/218 |
| 3,225,745 | 12/1965 | Hechtle | 401/31 |
| 3,274,976 | 9/1966 | Levoin | 401/31 |
| 3,294,068 | 12/1966 | Hechtle | 401/31 |
| 3,320,962 | 5/1967 | Moriber et al. | 401/31 |

FOREIGN PATENT DOCUMENTS

| | | | |
|---|---|---|---|
| 965661 | 9/1950 | France | 401/31 |
| 685591 | 3/1965 | Italy | 401/31 |

*Primary Examiner*—John J. Wilson
*Assistant Examiner*—Frank A. LaViola
*Attorney, Agent, or Firm*—Wenderoth, Lind & Ponack

[57] ABSTRACT

A make-up brush device, designed for use in beautifying the cheeks or lips, comprises a cylindrical casing which provides several individual spaces therein defined by a separator of flexible material extending axially, each individual space being provided for accommodating each respective brush stick mounted for axial sliding movement. Those individual brush sticks may be selected, depending upon the specific requirements, by causing the appropriate brush stick to travel axially toward the head end of the cylindrical casing.

11 Claims, 8 Drawing Sheets

MAKE-UP BRUSH DEVICE

BACKGROUND OF THE INVENTION

1. Field of the Invention

The present invention relates generally to a make-up brush device, and more specifically to a make-up brush device designed to beautify the face, that consists of a pen-type container that accommodates a set of a plurality of individual brush sticks, from which any brush stick may be used selectively.

2. Description of the Prior Art

There is a known make-up brush device. The typical prior art make-up brush device is shown in FIG. 28. As seen from FIG. 28, it consists of a cylindrical case 55 that contains a single brush stick 56 that is capable of axial sliding movement. To accomplish this axial sliding movement, a pushing member 58 is provided inside a cap 57, extending inwardly from the closed end, or the bottom end, of the cap. When the cap 57 is placed on the other end of case 55 from that shown in FIG. 28, the pushing member 58 acts upon the brush stick 56 so that it will move forward. A spring 59 is also provided, which is biased to bring the brush stick 56 back to its original position when it is released from the pushing member.

SUMMARY OF THE INVENTION

The prior art device as described above has several problems. For one, it can only accommodate a single brush stick. When more than one brush stick is used selectively, depending upon whether rouge or coloring is to be applied by a particular brush stick, the corresponding number of such devices must be provided.

Another problem is encountered when the face is beautified by applying several different rouges or colorings on the cheeks or lips or by using several brush sticks which have brushes of different diameters. In this case, those brush sticks may be used selectively, depending upon the coloring to be applied or the diameter size of the brush stick, but as many brush devices as the number of colors and diameters, each of which contains a single brush stick to be used for the particular purpose, must be provided.

The present invention solves the above problems by offering a make-up brush device that consists of a pen-type container capable of accommodating a set of several brush sticks that may be selected for the particular purposes.

The make-up brush device according to the present invention consists generally of a cylindrical casing, usually in the form of a pen, in which a guide member is mounted for axial movement and for defining separate spaces extending longitudinally. In each of the separate spaces, a brush stick is mounted so that it can travel axially slidably. The guide member includes a ring located in the middle thereof, and each of those brush sticks has an enlarged portion at the rear end thereof. Each brush stick is biased by a spring which is mounted between the ring on the guide member and the enlarged portion at the rear end of the brush stick. A cap is demountably mounted on the cylindrical casing. This cap is usually mounted on the front end of the casing, and is remounted on the rear end when a particular brush stick is selected for use. A pushing member is provided inside the cap, extending inwardly and axially from the closed end, or the bottom end, of the cap. This pushing member is eccentric with regard to the center axis through the cap. With the cap mounted on the rear end of the casing, the pushing member acts upon the enlarged portion of the selected brush stick, pushing it forward axially.

In the specific form of the device, the separate spaces may be any number between two and four, in which the corresponding number of brush sticks, such as two to four, may be mounted axially slidably. Each of the brush sticks has a protruded portion extending laterally from its body, which is adapted to press against a flexible separator on the guide member which is later described. The guide member includes sheaths extending axially from its ring toward the head end, a separator of flexible material extending axially from its ring toward the head end and for defining several spaces extending axially between the sheaths, and a partition extending axially from its ring toward the rear end and for defining the spaces corresponding to those defined by the separator. The pushing member which acts upon the enlarged portion of the brush stick may have any shape in cross section, but preferably it should have the triangle cross section, which facilitates its use and allows a larger range of rotation for the cap.

Two brush sticks are shown in FIG. 1, but theoretically any number of brush sticks may be provided. For the practical purposes, two to four brush sticks should be provided, although two are the optimum.

The separator should preferably be flexible in order to permit a brush stick to be aligned with the center line through the casing when its head end or brush is pushed out of the casing. For this purpose, the separator may be mounted pivotally on a pin, or may be mounted by any other member of deformable or soft material. This allows the separator to be inclined when it is pressed against by the brush stick.

In another embodied form, the device consists of a cylindrical casing open at one end, and closed at the other end, in which a flexible separator is extending axially for defining several separate spaces from the closed end, and a brush stick is mounted for axial sliding movement in each of the spaces. Each brush stick is equipped with a brush at its head end, and is equipped with a contact member at its rear end which elastically engages the inner wall of the casing and the flexible separator. The contact member includes an operating member at its end extending through the casing wall, which engages an elongated slit formed in the casing wall and extending longitudinally from the closed end toward the open end of the casing, so that the operating member can travel therein. The contact member has a forked shape at its end, consisting of one branch engaging the separator and the other branch engaging the inner casing wall. Like the preceding embodied form, the spaces in which the respective brush sticks are mounted slidably are preferably two or three, but may be any number of between four and six.

As may be understood from the foregoing description, the cylindrical casing, usually in the form of a pen, can accommodate a set of several brush sticks, and the cap, which is normally mounted on the head end of the casing, is removed and remounted on the rear end of the casing when it is used. The cap has the pushing member acting upon the particular brush stick selectively. To permit this selection, the pushing member is eccentric with regard to the center axis through the cap or casing. When a particular brush stick is to be used, the cap is rotated before it is pressed onto the casing until the pushing member is placed to engage that particular brush stick. This action causes the brush stick to be pushed forward, with its head end or brush appearing on the head end of the casing.

The separate spaces in which the brush sticks are mounted are defined by the separator of flexible material, and each of the brush sticks has the protruded portion for engaging the separator. When a particular brush stick is selected and is moved axially forward, its protruded portion presses against the separator of flexible material, forcing it to move laterally and thus allowing the head end of the brush stick to be aligned with the center axis of the casing.

As described, the feature of the present invention is the provision of a single casing which accommodates a set of several brush sticks from which a particular brush stick may be used selectively.

Another feature is the provision of several spaces defined by a separator within a single casing, whereby individual brush sticks may be mounted in the respective spaces, and may be used selectively by pushing the particular brush stick toward the open end of the casing.

Still another feature is the provision of a single casing that accommodates a set of several brush sticks that may be used selectively depending upon the particular needs. This provides convenience when it is stored or carried.

A further feature is the provision of a flexible separator for defining several spaces in which several brush sticks are mounted, and the provision of a protruded portion on each individual brush stick which engages the flexible separator, in order to permit the selected brush stick to be aligned with the center axis through the casing when it is moved out or in.

A further feature is the provision of a compact-size casing.

BRIEF DESCRIPTION OF THE DRAWINGS

Those and other objects, advantages, and features of the present invention will become more apparent from the description that follows with reference to several preferred embodiments shown in the accompanying drawings, in which:

FIG. 11 through FIG. 14 illustrate a variation of the brush stick in FIG. 5, in which FIG. 11 is a front view, FIG. 12 is an elevation view of part of the brush stick when it is not in use, FIG. 13 is an elevation view of part of the brush stick when it is beginning to move forward, and FIG. 14 is an elevation view of part of the brush stick when it has been pushed out of the casing;

DESCRIPTION OF THE PREFERRED EMBODIMENTS

The present invention will be described in further detail by referring to the several preferred embodiments thereof which are shown in the accompanying drawings. It should be understood that those embodiments are only shown specifically, but they are non-limitative as far as they don't depart from the spirit and scope of the invention, as defined in the appended claims.

EMBODIMENT 1

Referring first to FIG. 1 through FIG. 8 and FIG. 15, the first preferred embodiment of the present invention is described.

Figure 1:
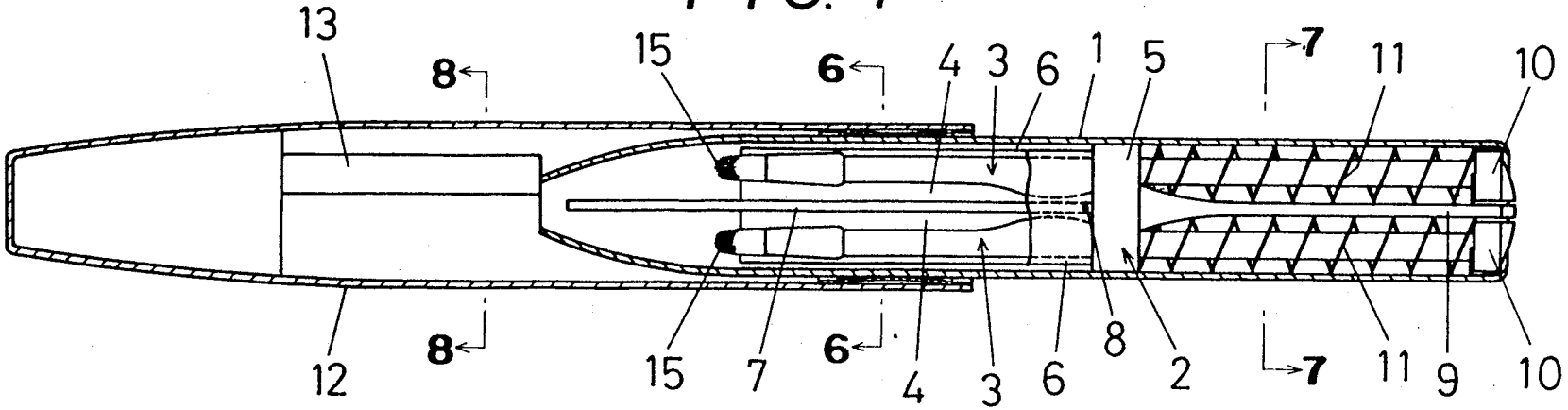
FIG. 1 is a sectional view of the make-up brush device according to one preferred embodiment of the present invention, showing how the brush sticks are placed in their respective positions with the cap mounted on the head end of the casing, when it is not in use.

In FIG. 1, a cylindrical casing 1, usually in the form of a pen, contains a guide member 2. The inner space of casing 1 is divided into two separate spaces 4, 4, upper and lower, in which brush sticks 3, 3 are mounted. The brush sticks 3, 3 are capable of axial sliding movement within the respecive spaces. The guide member 2 includes a ring 5 located at the middle thereof, as shown in FIGS. 1, 2, 3 and 4, and sheaths 6, 6 extending axially from the ring 5 toward the head end of the casing 1 and facing opposite each other laterally. A separator 7 extends axially between the sheaths 6, 6, and has its base end mounted pivotally to the base ends of the sheaths 6, 6 by means of a pivot pin 8. A partition 9 extends axially from the ring 5 toward the rear end of the casing 1. This partition 9 is provided for defining separate spaces, upper and lower, which correspond to the separate spaces 4, 4. As shown in FIG. 1, the brush sticks 3, 3 mounted in the respective spaces 4, 4 have an enlarged portion 10, 10 at their respective rear ends, and springs 11, 11 are mounted between the enlarged portions 10, 10 on the brush sticks 3, 3 and the ring 5 on the guide member 2. A cap 12 is normally mounted on the head end of the casing 1, and may be removed and remounted on the rear end of the casing 1. The cap 12 has a pushing member 13 inside it, extending axially from its closed end toward its open end. The pushing member 13 is eccentric with regard to the center axis through the cap, and acts upon the appropriate brush stick 3 by pressing against its enlarged portion 10 when it is selected. As seen from FIG. 5, each brush stick 3 consists of a body 14 and a brush 15 fastened to the head of the body 14 by means a metal band 16, the body 14 having a protruded portion 17 on the intermediate part. The protrusion 17 is adapted to press against the separator 7. The enlarged portion 10 at the rear end of the body 14 is exposed at the rear open end of the casing 1.

Figure 2:
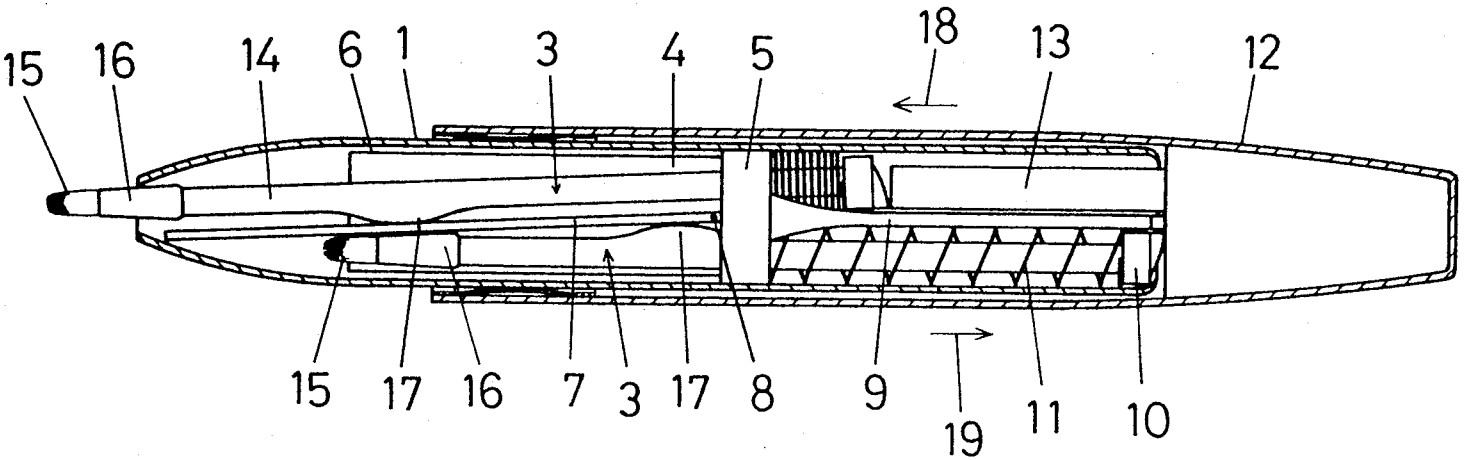
FIG. 2 is also a sectional view of the same device as in FIG. 1, showing how a particular brush stick is pushed out of the casing with the cap mounted on the rear end of the casing, when it is in use.
Figure 3:
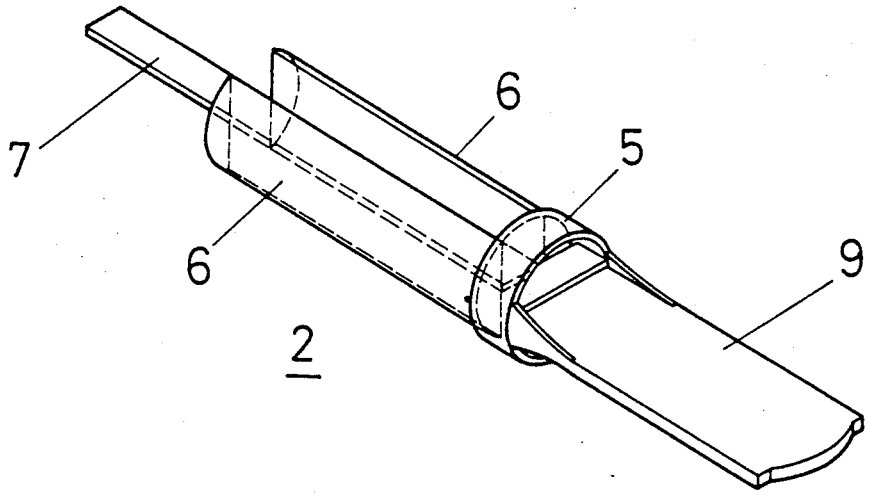
FIG. 3 is a perspective view showing the guide member in the embodiment of FIG. 1.
Figure 4:
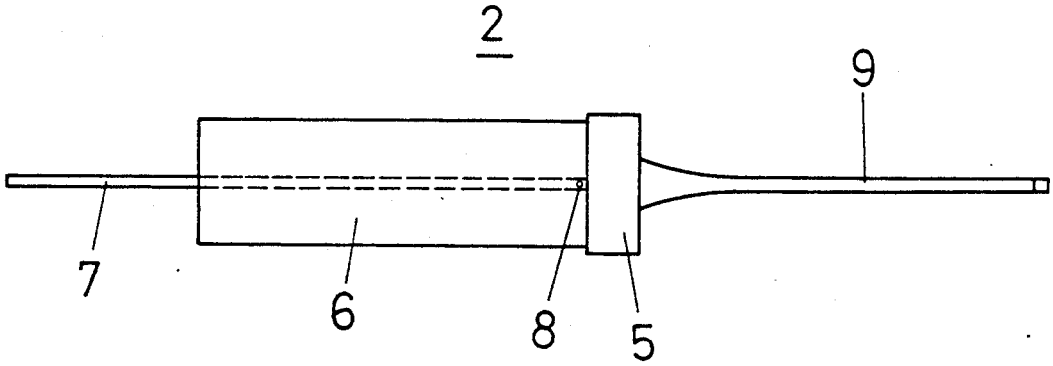
FIG. 4 is an elevation view of the guide member shown in FIG. 3.
Figure 5:
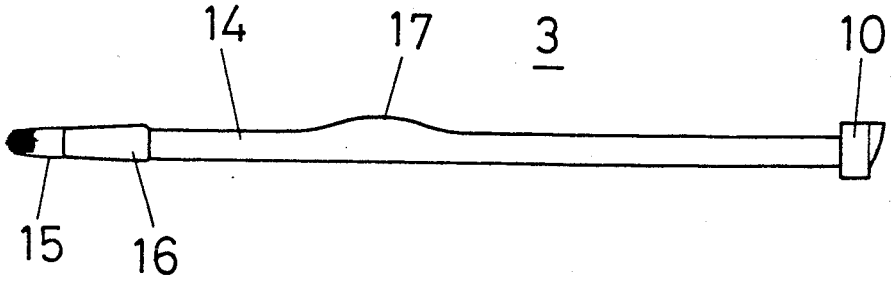
FIG. 5 is an elevation view of a brush stick.
Figure 6:
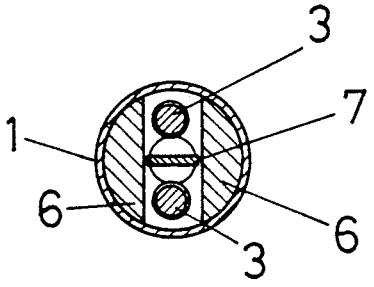
FIG. 6 is a sectional view taken along the line 6—6 in FIG. 1.

As described above, the cap 12 is usually mounted on the head end of the casing 1 when it is not in use, as shown in FIG. 1. In use, the cap 12 is removed from the head end of the casing 1, and is then remounted on the rear end of the casing 1, as shown in FIG. 2. The casing 1 has markers (not shown) on the wall at its open end, and the cap 12 also has the corresponding markers (not shown) on the wall at its open end. Those markers serve to select a desired brush stick by turning the cap so that the appropriate marker on the cap is set to the corresponding marker on the casing. When the desired brush stick is thus selected, the cap 12 is pushed forward as indicated by an arrow 18 in FIG. 2. This pushing action causes the pushing member 13 on the cap to engage the enlarged portion 10 of the selected brush stick 3 and press against it. Pressing the enlarged portion 10 forward causes the associated brush stick 3 to move forward until its head end goes out of the head open end of the casing 1 (FIG. 2). This brush stick 3 may be used to apply a particular coloring, such as pink, rouge, and so on, on the cheeks or lips.

Upon finishing, the cap 12 is removed from the rear end of the casing 1, and the brush stick 3 that has just been used will then be brought back to its original position under the restoring action of the spring 11, as indicated by an arrow 19.

Figure 7:
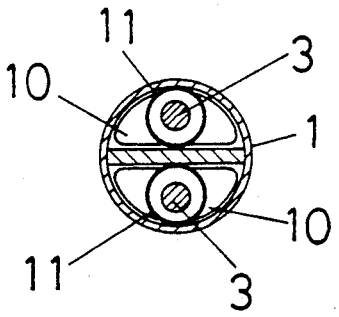
FIG. 7 is a sectional view taken along the line 7—7 in FIG. 1.
Figure 8:
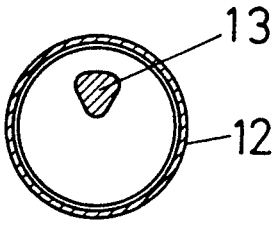
FIG. 8 is a sectional view taken along the line 8—8 in FIG. 1.
Figure 15:
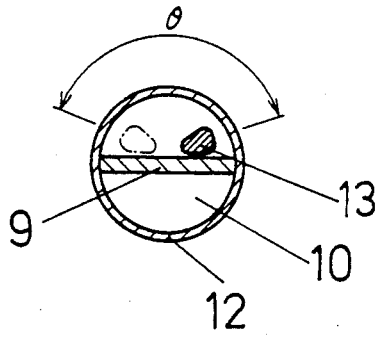
FIG. 15 illustrates the angle through which the pushing member can rotate when a particular brush stick is selected.

Each of the brush sticks 3 may have an enlarged portion 10 at its rear end that provides the lateral arcuated side, as shown in FIG. 7. This affords some inaccuracy when the cap 12 is turned, and ensures that the pushing member 13 engages the enlarged portion 10 of the appropriate brush stick 3. The pushing member 13 should preferably have a triangular cross section, as shown in FIG. 8, but may have any other cross section, such as circular, elliptical, and the like. As shown in FIG. 15, however, the triangle cross section provides the maximum pivot angle $\theta$ which allows the cap 12 to have greater freedom of rotation. The importance is that the shape in cross section and size of the pushing member 13 should be such that the pushing member 13 cannot enter the open end of the casing 1.

EMBODIMENT 2

Figure 9:
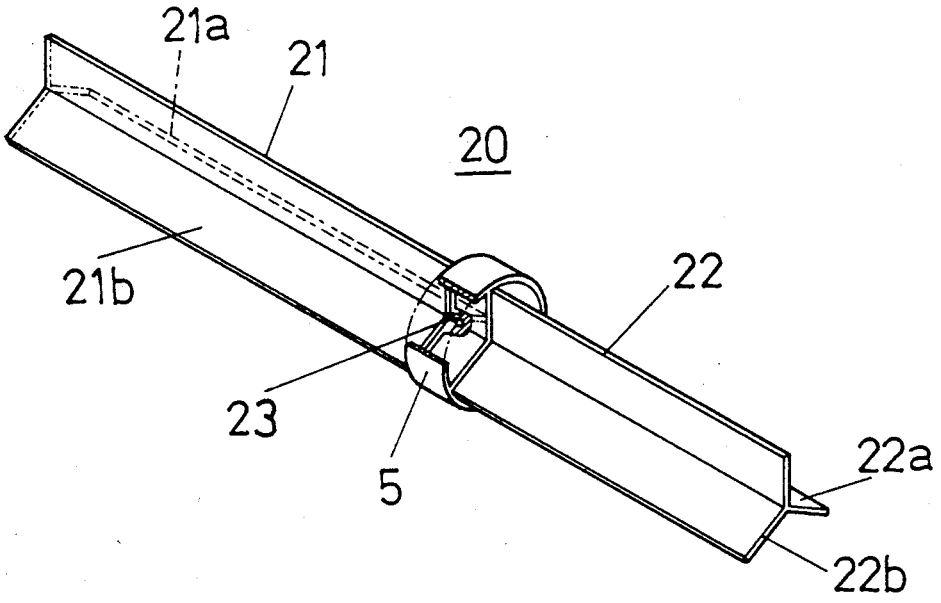
FIG. 9 is a perspective view showing a variation of the guide member shown in FIG. 4.
Figure 10:
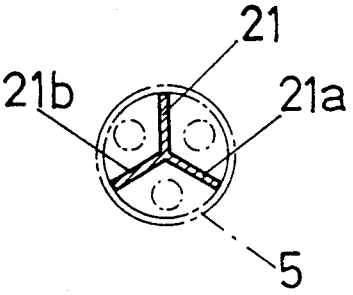
FIG. 10 is a partly sectional view of the guide member in FIG. 9.
Figure 11:
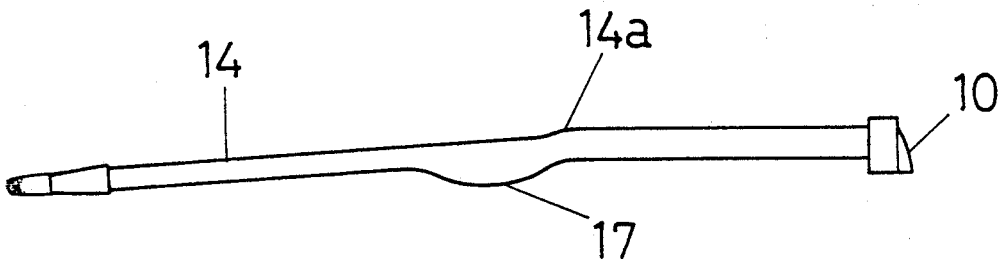
Figure 12:
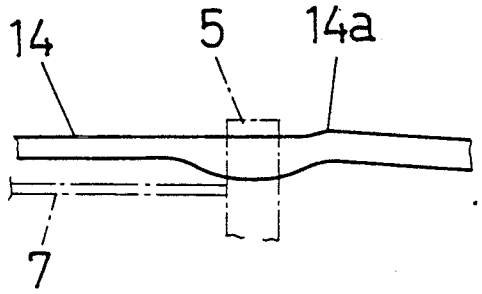

In the preceding embodiment, the cylindrical casing 1 is provided for accommodating two brush sticks. In the current embodiment shown in FIGS. 9 and 10, the cylindrical casing 1 provides three brush sticks 3. This may be achieved by providing a guide member 20 that includes three separators 21, **21*a*, 21*b* and three partitions 22, 22*a*, 22*b***. As a further variation, four or more brush sticks may also be provided by increasing the number of the separators and partitions to four or more. This description may apply to three or more brush sticks, but is specifically provided for the three brush sticks for simplicity of understanding.

The separators 21, **21*a*, 21*b* have their rear ends mounted pivotally to the center of the ring 5 by means of any suitable connecting pin or rod 23**. Any other connecting means may be employed.

EMBODIMENT 3

Referring next to FIGS. 11 through 14, a variation of the brush stick 3 is described.

Figure 13:
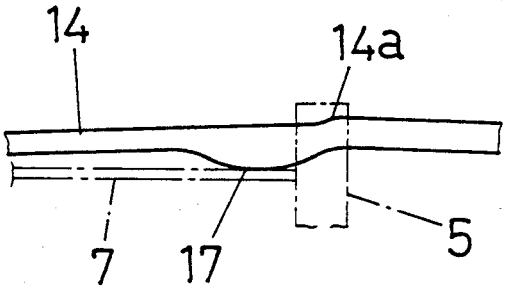
Figure 14:
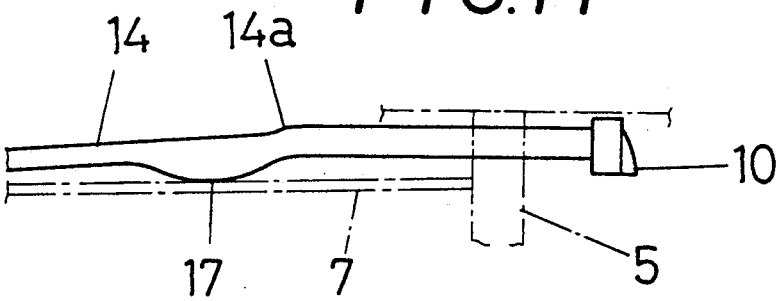

The brush stick 3 has a body 14 which is varied from those in the preceding embodiments. In this variation, the body 14 also includes a protruded portion 17, but includes a slightly curved portion **14*a* behind the protruded portion 17. In this way, when the protruded portion 17 is located within the ring 5 (FIG. 12), the body 14 is placed in parallel with the inner wall of the casing 1. When the brush stick is pushed forward, moving the protruded portion 17 out of the ring 5, the body 14 is inclined slightly downwardly by engagement of projection 14*a* with ring 5 (FIG. 13). As the brush stick is further pushed forward, the head end of the brush stick can be placed in the middle of the head open end of the casing 1, as shown in FIG. 14. The form of the body 14, the location of the protruded portion 17 on the body 14 and how far the head end of the brush stick extends out of the casing 1** may be determined optionally.

EMBODIMENT 4

Figure 16:
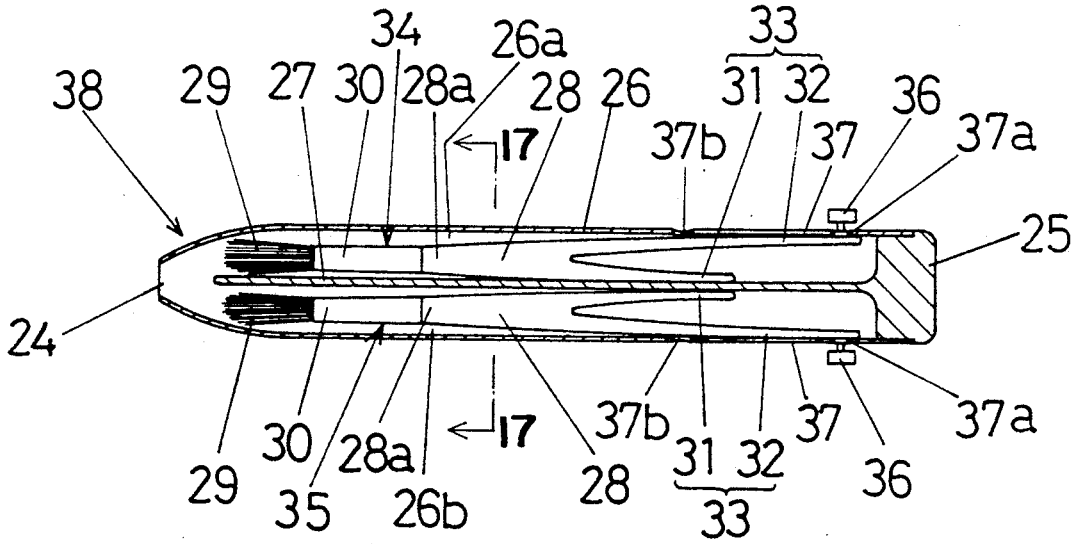
FIG. 16 is a side elevation of a variation of the casing, shown partly broken away.
Figure 17:
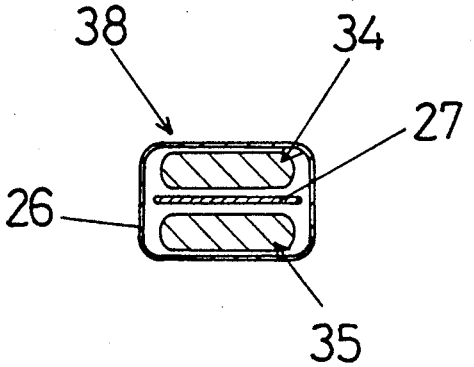
FIG. 17 is a sectional view taken along the line 17—17 in FIG. 16.

Referring to FIGS. 16 and 17, there is shown a variation of the preceding embodiments. As shown, a cylindrical casing 26 is open at one end thereof 24, and is closed at the opposite end by a covering 25. In the casing 26, there is a flexible separator 27 that extends axially from the covering 25 toward the open end 24. The flexible separator 27 is fixed at its one end to the covering 25, and separates the interior of the casing 26 into two spaces **26*a*, 26*b*** extending axially.

Each brush stick 34, 35 consists of a body 28 having a brush 29 connected to its head end **28*a*. The connection between the brush and body may be accomplished by using a metal or synthetic resin coupler 30, such as a sleeve, that is mounted over the side of the brush 29 that is located near to the body 28 and the head end portion 28*a* of the body 28. The body 28 has a forked contact member 33 consisting of branches 31, 32**.

Two brush sticks 34, 35 are mounted in the respective spaces **26*a*, 26*b* within the casing 26. Each brush stick is mounted with its one branch, as for example shown by 31, resiliently engaging the flexible separator 27 elastically, and with its other branch, as for example shown by 32, resiliently engaging the inner wall of the casing 26. The branch 32 has an operating member 36 extending laterally from its head end portion. The operating member 36 extends through the casing 26. The casing 26 has an elongated slit 37 extending longitudinally, and the operating member 36 engages in the elongated slit 37** so as to travel along it.

Figure 18:
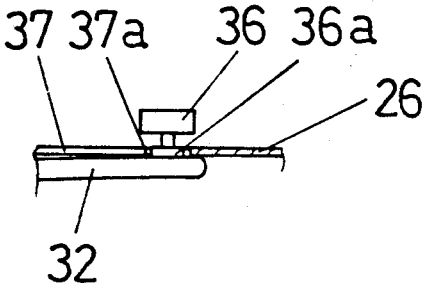
FIG. 18 is a side elevation showing the operating member as partly enlarged.

As shown in FIGS. 16 and 18, the elongated slit 37 is wider at the opposite ends **37*a*, 37*b* so as to accept and engage the base 36*a* of the operating member 36**.

Figure 19:
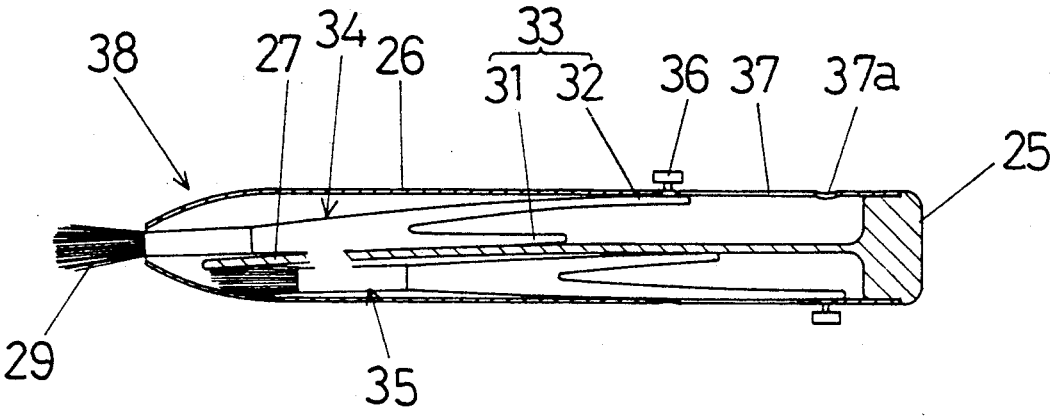
FIG. 19 is a side elevation of the casing in FIG. 16, showing it as partly broken away when it is in use.
Figure 20:
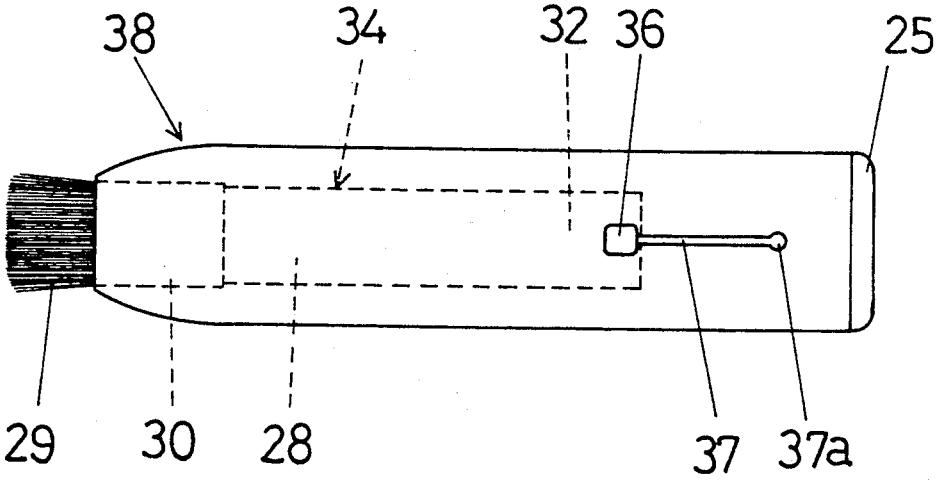
FIG. 20 is a plan view of the casing in FIG. 19.

Referring next to FIGS. 19 and 20, the operation is described. When a particular brush stick, such as the one shown by 34 is to be used, the operating member 36 for the brush stick 34 is depressed, releasing or disengaging its base 36*a* from the wider portion 37*a* of the elongated slit 37. Then, the operating member 36 is moved to travel along the elongated slit 37 toward the open end 24, and the brush stick 34 also travels with it. As the brush stick 34 is traveling with the branch 31 making resilient contact with the flexible separator 27 and with the branch 32 making resilient contact with the inner wall of the casing 26, the flexible separator 27 is being bent downwardly toward the other brush stick 35. The operating member 36 is moved further toward the open end 24 until its base 36*a* reaches the opposite wider portion 37*b* of the elongated slit 37. When the base 36*a* engages the wider portion 37*b*, the brush 29 on the brush stick 34 appears out of the open end 24 (FIG. 19 and FIG. 20). The steps described above are reversed when the brush stick 34 is returned to its original position.

The above described steps apply to the other brush stick 35 when it is used.

In a varied from, the contact member 33 may have a hollow cylindrical shape of flexible material, instead of the forked shape, and may have its outer peripheral end adapted to engage both the flexible separator 27 and the inner wall of the casing 26. As another variation, the contact member 33 may be configured to provide symmetrical protrusions of flexible material, one extending upwardly from the body 28 and adapted to resiliently engage the flexible separator 27 or the inner wall of the casing 26, and the other extending downwardly from the body 28 and adapted to resiliently engage the inner wall of the casing 26 or the flexible separator 27. The brush sticks 34 and 35 may be of the similar type or a different type.

EMBODIMENT 5

Figure 21:
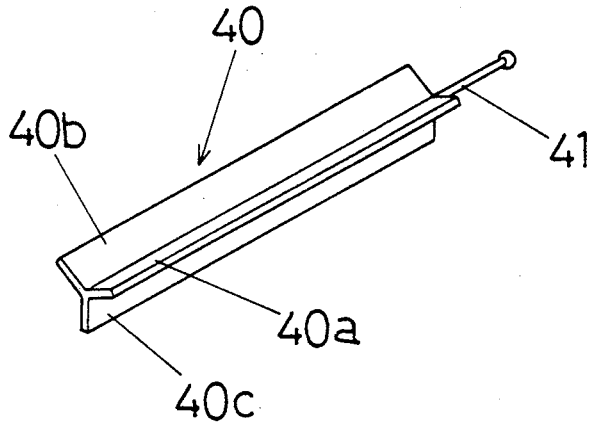
FIG. 21 is a perspective view of a variation of the separator according to another embodiment.
Figure 22:
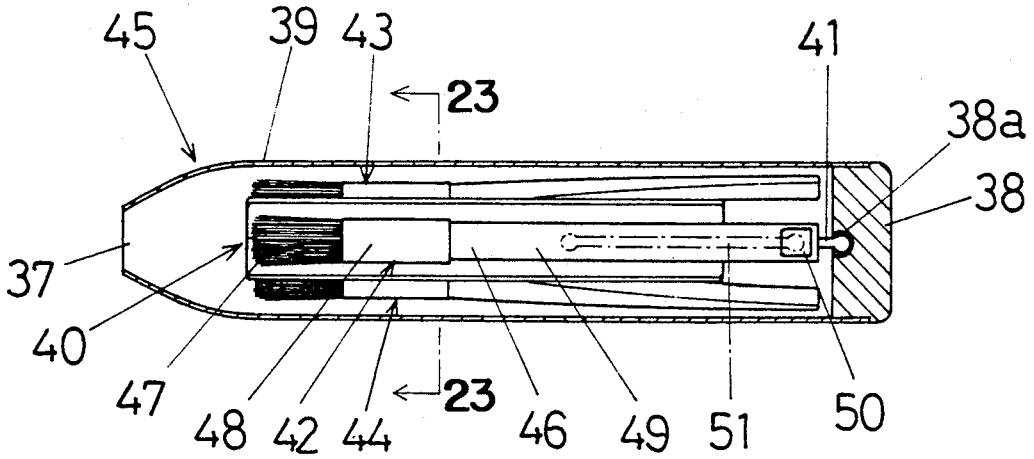
FIG. 22 is a side elevation of the casing in the embodiment in FIG. 21.
Figure 23:
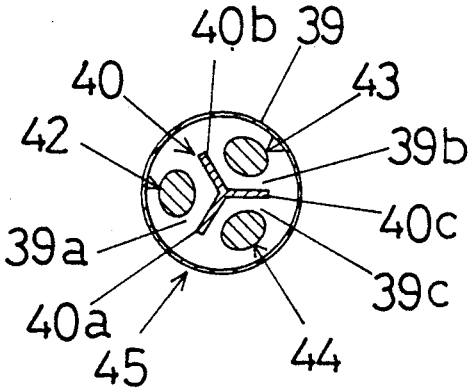
FIG. 23 is a sectional view taken along the line 23—23 in FIG. 22.

Referring to FIGS. 21 through 23, there is a shown variation of the separator. In this variation, a cylindrical casing 39 is open at one end thereof 37, and is closed at the opposite end with a covering 38. A separator 40 includes three flexible blades 40*a*, 40*b*, 40*c* extending longitudinally and radially at regular intervals, and a support rod 41 extending axially toward the covering 38 (FIGS. 21 and 22). The end of the support rod 41 that is located at the covering 38 is shaped like a bead. The inner side of the covering 38 that faces the support rod 41 has a recess 38*a* which accepts the bead of the support rod 41 so that the support rod can pivot on its bead (FIG. 22). When the separator 40 is mounted in the casing 39, it provides three spaces 39*a*, 39*b*, 39*c* extending axially (FIG. 23).

Individual brush sticks 42, 43, and 44 are placed in their respective spaces 39*a*, 39*b*, and 39*c*. The complete make-up brush device is designated by 45 in FIG. 22. Each of the brush sticks 42, 43, 44 has a substantially circular cross section, and has the same construction as that in the fourth embodiment, which includes a brush 47, a coupler or sleeve 48, a contact member 49, and an operating member 50. The operating member 50 for the brush stick 42, and the other operating members for the remaining brush sticks 43, 44 (which are not shown) also have the same construction as that in the fourth embodiment. For the operating member 50, for example, it is adapted to engage an elongated slit 51 on the casing 39.

Likewise, the brush stick 42 has its contact member 49 adapted to elastically engage the separator 40 and the inner wall of the casing 39. The remaining brush sticks 43 and 44 also have their respective contact members (not shown) adapted to elastically engage the separator 40 and the inner wall of the casing 39. In this embodiment, the contact member 49, for example, may have the forked or hollow cylindrical shape, as for the fourth embodiment, which are adapted to elastically engage the separator 40 and the inner wall of the casing 39. The contact member may have any shape or configuration as long as those provide flexibility when they engage the separator 40 and the inner wall of the casing 39.

Figure 24:
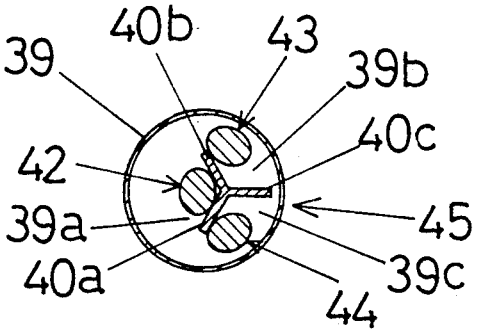
FIG. 24 is a transverse sectional view showing a particular brush stick when in use in the embodiment in FIG. 21.

The operation of the device 45 in the current embodiment may proceed, following the steps as described in the fourth embodiment. The positions that the separator 40 and the remaining brush sticks 43, 44 assume when the brush stick 42 is in use are shown in FIG. 24.

In the current embodiment wherein the support rod 41 extends from the separator 40 and has the bead at the end which engages the recess 38*a* in the covering 38 and is supported pivotally therein, the support rod 41 which is made of flexible material may be provided on the covering 38, extending from the covering 38 to be connected with the separator 40.

Figure 25:
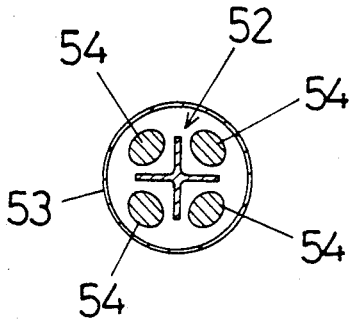
FIG. 25 is a transverse sectional view of another embodiment in which four spaces are provided.
Figure 26:
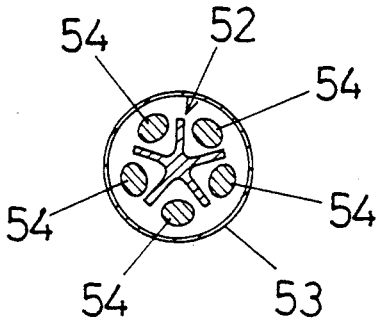
FIG. 26 is a transverse sectional view of another embodiment in which five spaces are provided.
Figure 27:
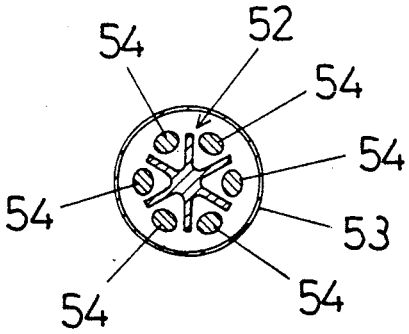
FIG. 27 is a transverse sectional view of another embodiment in which six spaces are provided.
Figure 28:
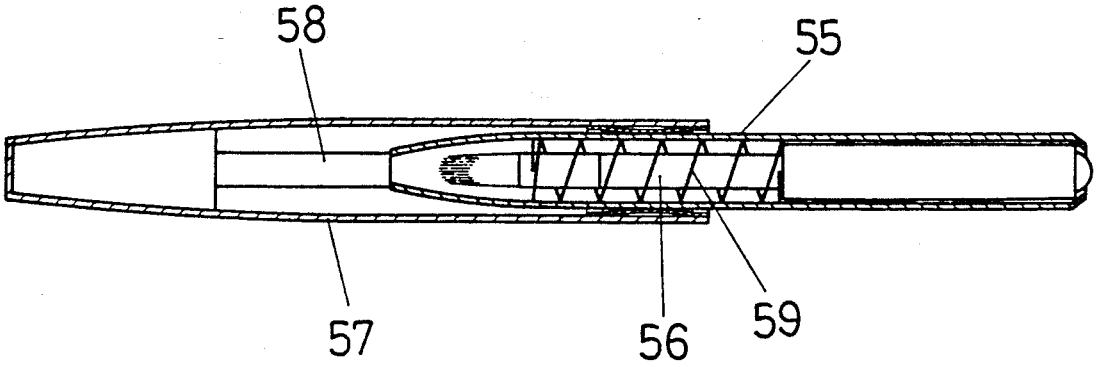
FIG. 28 is a sectional view of the typical construction according to the prior art when it is not in use.

FIGS. 25 through 27 illustrate respective variations of the separator 40 described in the current embodiment. In those variations, a separator 52 may include four to six blades of flexible material extending longitudinally and radially at regular intervals for providing four to six spaces extending axially when the separator 52 is mounted in the casing 53. Four to six individual brush sticks 54 may be mounted in their respective spaces.

Although the present invention has been described with reference to the several preferred embodiments and variations thereof, it should be understood that various changes and modifications may be made without departing from the spirit and scope of the invention.

What is claimed is:

1. A make-up brush device for use in beautifying the face, comprising:

a cylindrical casing having a head end and a rear end;

a guide means positioned within said cylindrical casing and extending axially for defining a plurality of separate spaces extending longitudinally in said cylindrical casing, said guide means including a ring at the middle thereof, a separator extending longitudinally from said ring toward the head end of said cylindrical casing for separating the space within the casing into said separate spaces, said separator having the end toward said head end shiftable laterally of said cylindrical casing, and a partition extending axially toward the rear end of said casing for defining a number of individual spaces extending axially and corresponding to said separate spaces defined by said separator;

a plurality of individual brush sticks each mounted within a corresponding one of said plurality of separate spaces for axial sliding movement therein, each of said brush sticks having an enlarged portion at a rear end thereof extending into the corresponding individual space, and each having a protruded portion on the body thereof which presses against said separator when the brush stick is moved axially toward the head end for shifting said separator laterally of said cylindrical casing;

spring means between said ring and said enlarged portion of each brush stick for biasing the brush sticks toward a retracted position within said casing; and cap means normally demountably mounted on the head end of said cylindrical casing and remountable on the rear end thereof, said cap means including a pushing means extending inwardly from said cap means eccentrically with regard to a center axis through said cylindrical casing and selectively acting on the enlarged portions of the respective brush sticks so that any selected brush stick can be pushed axially forward to a projected position at the head end of said cylindrical casing.

2. A make-up brush device as claimed in claim 1 in which said separator is made of flexible material and is bent laterally by said protruded portions of said brush stick bodies when said brush sticks are moved toward the head end of said cylindrical casing.

3. A make-up brush device as claimed in claim 1 in which said separator is pivotally mounted on said ring and is pivoted laterally by said protruded portions of said brush stick bodies when said brush sticks are moved toward the head end of said cylindrical casing.

4. A make-up brush device as claimed in claim 1 further comprising sheaths extending from said ring toward the head end of said cylindrical body and defining a space therebetween, and said separator is between said sheaths for separating the space defined between said sheaths into said separate spaces.

5. A make-up brush device as claimed in claim 1 wherein there are two to four separate spaces for accomodating individual brush sticks.

6. A make-up brush device as claimed in claim 1 wherein said pushing means is a pushing member having a triangular cross-section.

7. A make-up brush device as claimed in claim 1 wherein each of said individual brush stick bodies further includes a slightly projecting curved portion thereon toward said rear end from and on the opposited side of the brush stick body from said protruded portion, said protruded portion and said curved portion each having a shape for, when said protruded portion is within said ring, the brush stick is substantially parallel with the axis of said cylindrical casing, and when said curved portion moves into said ring during forward movement of the brush stick, said brush stick is inclined toward said protruded portion.

8. A make-up brush device for use in beautifying the face, comprising:

a cylindrical casing having an open head end and a closed rear end;

a separator positioned within said cylindrical casing and extending axially from said closed end toward the open end for defining a plurality of separate spaces extending longitudinally in said cylindrical casing, said separator having the end toward said head end shiftable laterally of said cylindrical casing;

a plurality of individual brush sticks each mounted within a corresponding one of said plurality of separate spaces for axial sliding movement therein, each of said brush sticks having a brush at the end toward the head end and a contact member at a rear end thereof resiliently engaging the inner wall of said cylindrical casing and said separator; and operating means associated with each brush stick and extending laterally from the end of said contact member which is toward the end of said casing, said cylindrical casing having an elongated slot therein corresponding to each separate space and extending longitudinally from the closed end toward the open end in which the operating means is slidable for causing axial sliding movement of the associated brush stick.

9. A make-up brush device as claimed in claim 1 in which said separator is made of flexible material and is bent laterally by the contact member of the brush stick bodies when said brush sticks are moved toward the head end of said cylindrical casing.

10. A make-up brush device as claimed in claim 1 in which said separator is pivotally mounted at said closed rear end and is pivoted laterally by the contact member of the brush stick bodies when said brush sticks are moved toward the head end of said cylindrical casing.

11. A make-up brush device as claimed in claim 1 in which there are from two to six separate spaces for accomodating individual brush sticks.

* * * * *